US007671279B2

(12) United States Patent
Yin

(10) Patent No.: US 7,671,279 B2
(45) Date of Patent: Mar. 2, 2010

(54) CURRENT-SEEN CABLE

(75) Inventor: Yongjiang Yin, #45, Ti Yun Road, Rong Gui Town, Shunde District, Foshan, Guangdong 528300 (CN)

(73) Assignees: Yongjiang Yin (CN); Yuqiang Wang (CN)

( * ) Notice: Subject to any disclaimer, the term of this patent is extended or adjusted under 35 U.S.C. 154(b) by 0 days.

(21) Appl. No.: 12/092,296

(22) PCT Filed: Nov. 10, 2005

(86) PCT No.: PCT/CN2005/001890

§ 371 (c)(1),
(2), (4) Date: May 1, 2008

(87) PCT Pub. No.: WO2007/053977

PCT Pub. Date: May 18, 2007

(65) Prior Publication Data

US 2008/0277135 A1 Nov. 13, 2008

(51) Int. Cl.
*H01B 11/02* (2006.01)

(52) U.S. Cl. ..... 174/113 R

(58) Field of Classification Search ..... 174/113 R, 174/112

See application file for complete search history.

(56) References Cited

U.S. PATENT DOCUMENTS 5,869,930 A * 2/1999 Baumberg et al. ..... 313/506
6,957,001 B2 10/2005 He
6,960,725 B2 11/2005 Zhengkai et al.
2004/0145313 A1 7/2004 He

FOREIGN PATENT DOCUMENTS

| | | |
|---|---|---|
| CN | 1277793 | 12/2000 |
| CN | 2471051 | 1/2002 |
| CN | 2501278 | 7/2002 |
| CN | 1446030 | 10/2003 |
| CN | 2599898 | 1/2004 |

* cited by examiner

*Primary Examiner*—Chau N Nguyen
(74) *Attorney, Agent, or Firm*—Schmeiser, Olsen & Watts, LLP

(57) ABSTRACT

A current-seen cable, includes a main cord as a power cord or a signal cord and a plurality of electroluminescence cords, said a plurality of electroluminescence cords are arrayed abreast and are intertwisted helically in sequence to be a electroluminescence cable which is insulated from the main cord and emit light section by section, in which every electroluminescence cord is controlled by a driver working in synchronization with the main cord to emit light in sequence. Said current-seen cable is driven to emit light by a plurality of output drivers controlled by the program-operated chip. When the main cord is live, the drivers work synchronously, then each electroluminescence cord emits and dies light periodically under the control of program-operated chip of the driver, and as each electroluminescent cord is intertwisted helically and people can only see one side of the cable visually, said whole cable is shown as a kind of lighting phenomenon in which a lighting section (or a lighting dot) of said cable goes after another section (or another dot) next to it. The visual direction for going after light is same as the direction of the current flowing in the main cord, so it can indicate the direction of power input and output.

12 Claims, 7 Drawing Sheets

CURRENT-SEEN CABLE

FIELD OF THE INVENTION

The present invention relates to a power cord or cable, particularly to an electroluminescence power or signal cable.

BACKGROUND OF THE INVENTION

The conventional power cable, communication cable and signal cable can not indicate whether it is in live state, and also can not indicate the direction of the current in said cable.

It is known that the electroluminescence cable is widely used for decorating the lamps. For example, CN 02115607.7 disclosed an electroluminescence cable and a method for producing the same. The electroluminescence cable consists of at least a linear conductor as a central electrode, a layer of insulating material applied on the central electrode, a electroluminescence layer of mixture of fluorescent powder and binder applied on the layer of insulating material, a transparent conductive layer composed of nano grade conductive substance which the diameter of particle is equal to or smaller than 20 nm applied on the electroluminescence layer, the nano grade conductive substance as the transparent conductive layer also penetrate into the gaps formed in the mixture of the fluorescent powder and binder as the electroluminescence layer and at least a linear conductor as an outer electrode wound in spiral form on the above transparent conductive layer.

THE PURPOSE OF THE INVENTION

To overcome the above drawback in the prior art, an purpose of the invention is to provide a current-seen cable which assemble an electroluminescence cable and various power cord or signal cord, which is simple in structure and can visually indicate the live state of it.

DESCRIPTION OF THE INVENTION

The above purpose is achieved by providing a current-seen cable, said cable includes a main cord as a power cord or a signal cord and a plurality of electroluminescence cords, said a plurality of electroluminescence cords are arrayed abreast and are intertwisted helically in sequence to be a electroluminescence cable which is insulated from the main cord and emit light section by section, in which every electroluminescence cord is controlled by a driver working in synchronization with the main cord to emit light in sequence.

Said current-seen cable is driven to emit light by a multi-group output driver controlled by the program-operated chip. When the main cord is live, the driver works synchronously, then each electroluminescence cord emits and dies light periodically under the control of program-operated chip of the driver, and as each electroluminescent cord is intertwisted helically and people can only see one side of the cable visually, said whole cable is shown as a kind of lighting phenomenon in which a lighting section (or a lighting dot) of said cable goes after another section (or another dot) next to it. The visual direction for going after light is same as the direction of the current flowing in the main cord, so it can indicate the direction of power input and output.

Emitting light of the present invention can be in a variety of forms, is particularly shown as a lighting dynamic phenomenon in which a lighting section goes after another section next to it in sequence and indicate the live state of all kind of main cord such as a power cord, a signal cord. The present invention is particularly used for the power cable connecting the power supply and a general electrical device or household appliance and also for connecting the transmitting unit with the receiving unit in the technical field of computer, telecommunication and communication. The current-seen cable can show a dynamic effect of the live state and input power visually, that means said cable simulate and show the current flow state, we can see whether said cable is live. Additionally, the present invention can widely used in a variety of decoration and illumination fields and also used as a lighting cable in warning sign and fingerpost.

BRIEF DESCRIPTION OF THE FIGURES

LIST OF REFERENCE NUMBER AND ITS CORRESPONDING PARTS ON FIG. 1 TO FIG. 16

Figure 1:
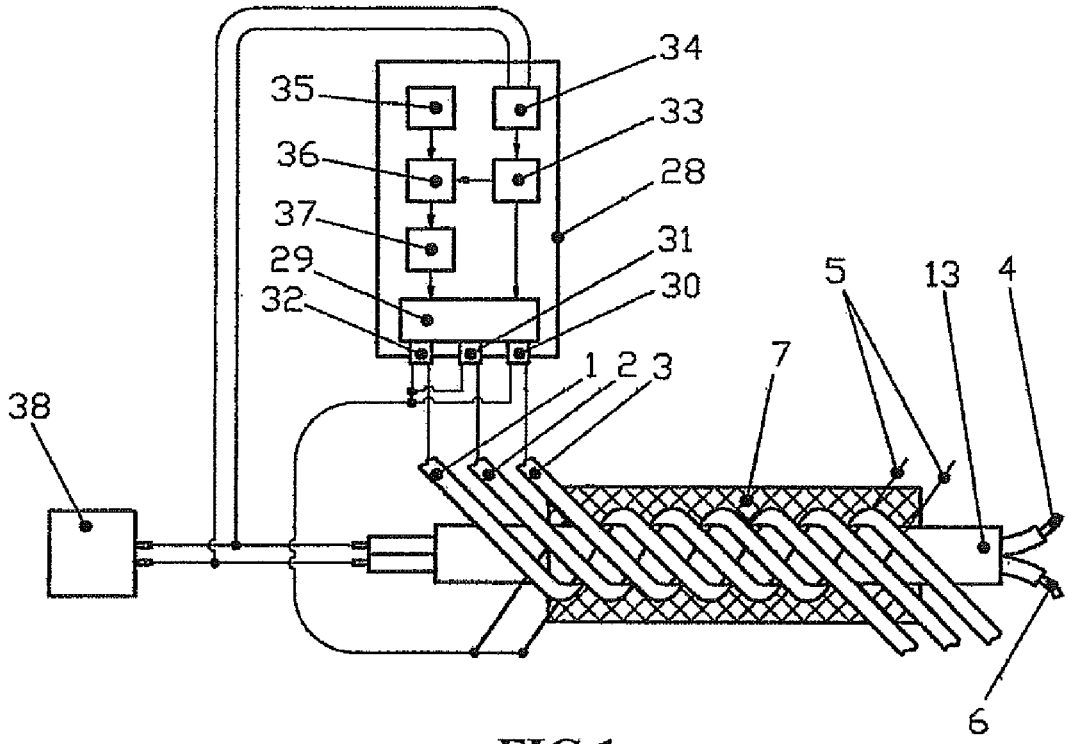
FIG. 1 is a schematic diagram of a first configuration of the present invention.

1, 2, 3—an electroluminescence cored bar or an electroluminescence cored cords;
4—a live wire of the power supply;
5—a bare metal wire;
6—a zero phase line of the power supply;
7—the transparent plastics layer;
8—a metal foil base strip;
9—a metal conductive wire base;
10—the insulating layer;
11—the layer of mixture of fluorescent powder and binder;
12—the transparent conductive layer;
13—the insulating layer;
14—the insulating layer or coating layer of the electroluminescence plastic or light sensitization glisten plastic.
16—a multi-core power or signal cord;
17—an electroluminescence cored bar;

18—an electroluminescence cable in which an electroluminescence cored cords is intertwisted on a bare metal wire;
19—computer;
20—printer;
21—a plug encapsulating the driver of the current-seen cable;
22—monitor;
23—a plug used in the vehicle;
24—mobile phone;
25—a plug;
26—a current-seen cable;
27—AC electrical outlet;
28—driver having multiple AC outputs;
29—3-group output unit;
30—third group AC output circuit;
31—second group AC output circuit;
32—first group AC output circuit;
33—high-frequency inverter circuit;
34—AC-DC rectifier or DC power supply;
35—synchronization circuit;
36—DC voltage stabilization circuit;
37—program-operated chip;
38—power supply switch;
39—an electroluminescence cored cords;
40—first electroluminescence cored cords;
41—second electroluminescence cored cords;
42—third electroluminescence cored cords;
43—Electric appliance

DETAILED DESCRIPTION OF EXEMPLARY EMBODIMENTS

A current-seen cable of the present invention, includes a main cord as a power cord or a signal cord and a plurality of electroluminescence bars or cords, said a plurality of electroluminescence bars or cords are arrayed abreast and are intertwisted helically in sequence to be a electroluminescence cable which is insulated from the main cord and emit light section by section, in which every electroluminescence cord is controlled by a driver working in synchronization with the main cord to emit light in sequence.

The positional relationship between the electroluminescence cable and the main cord can be that the main cord pass through the central axis of the electroluminescence cable or the main cord is arranged lateral to the electroluminescence cable and in parallel to the electroluminescence cable.

The electroluminescence cord of the present invention can be the conventional electroluminescence cord or the electroluminescence cored bar or the electroluminescence cored cord, wherein said electroluminescence cored bar consists of a metal foil base strip with an insulating coating, an electroluminescence powder coating on said insulating coating and a transparent conductive coating on said electroluminescence powder coating. Said the electroluminescence cored cord is formed by removing the auxiliary bare wire on the conductive layer of the conventional electroluminescence cord, the configuration of which is that a base metal cord is coated with insulating medium, an fluorescent powder coating and a transparent conductive layer in sequence.

The several current-seen cables with the different configuration will be as following by using the conventional electroluminescence cord, the electroluminescence cored bar or the electroluminescence cored cord.

In the present invention, in order to enhance the lighting effect of said current-seen cable, the insulation layer of the power cord or signal cord can be made of electroluminescence plastic or light sensitization glisten plastic. As well as at least a strip of electroluminescence plastic or a strip with light sensitization glisten plastic coating is provided on a transparent plastics layer of said current-seen power cable, said strip is in parallel to the power cord and the electroluminescence cable.

Embodiment 1

Figure 2:
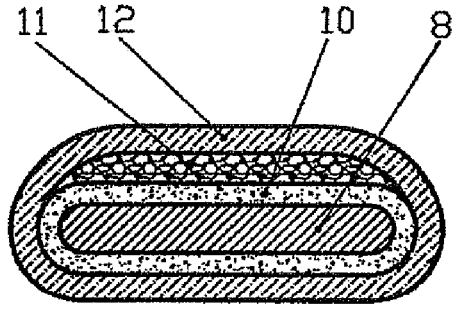
FIG. 2 is a radial sectional view of an electroluminescence cored bar of a first configuration of the present invention.
Figure 3:
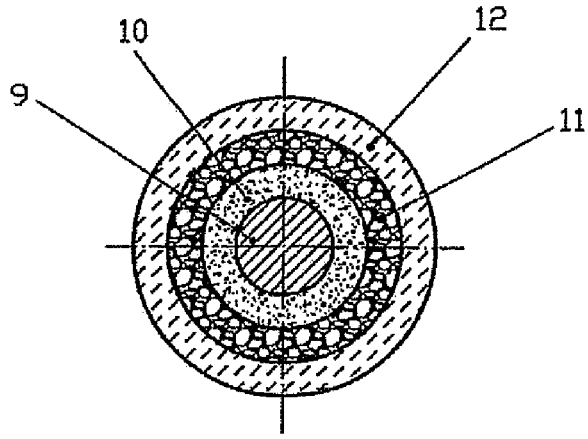
FIG. 3 is a radial sectional view of an electroluminescence cored cord of a first configuration of the present invention.
Figure 4:
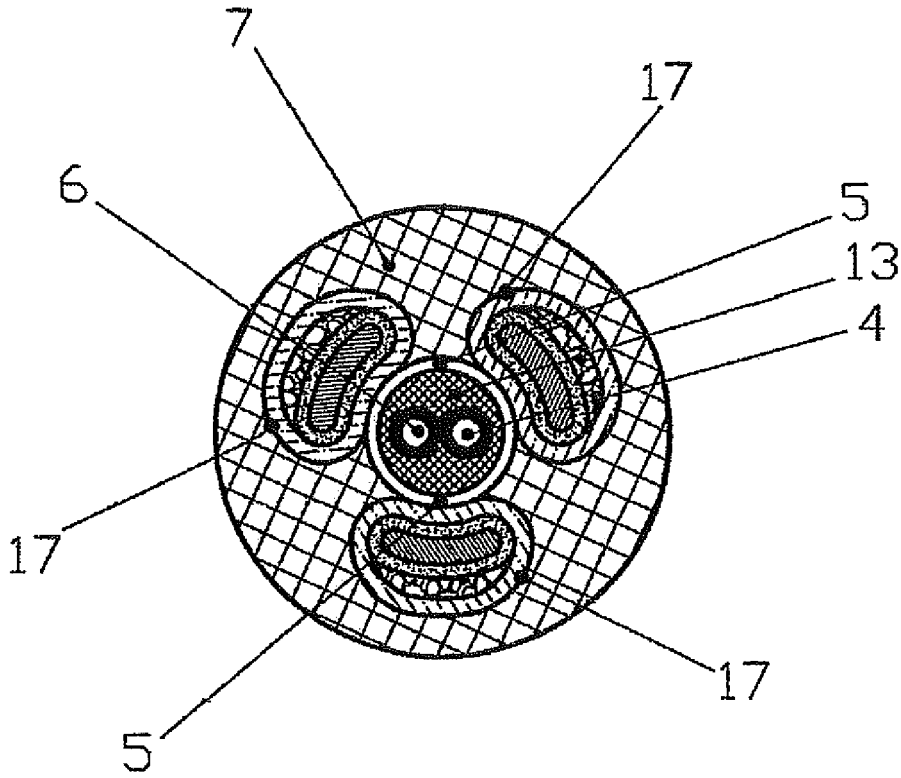
FIG. 4 is a radial sectional view of a first form of a first configuration of the present invention.
Figure 5:
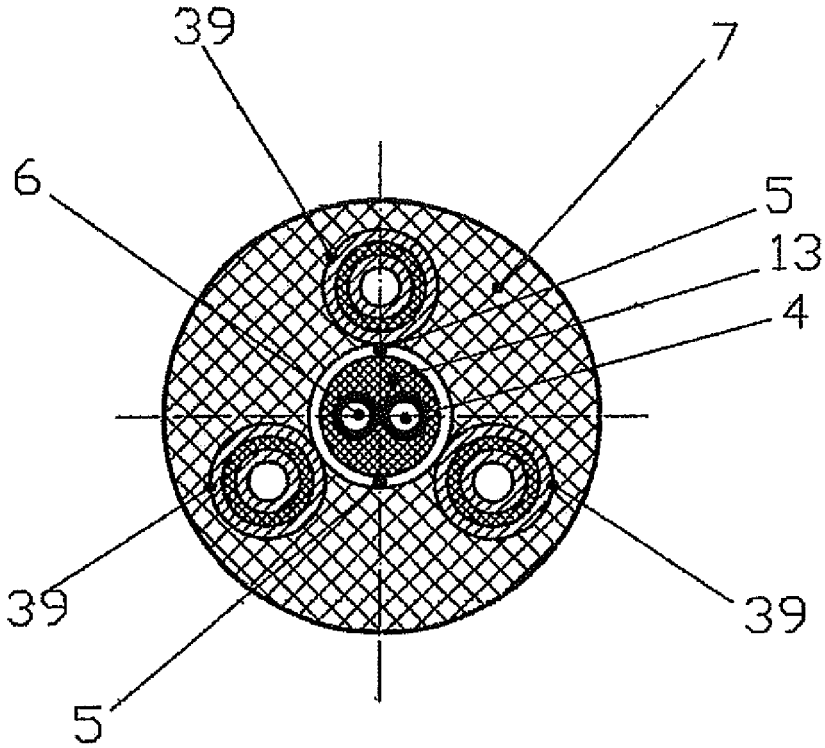
FIG. 5 is a radial sectional view of a second form of a first configuration of the present invention.

Referring to FIGS. 1, 2, 3, 4 and 5, the present invention uses an electroluminescence bar or an electroluminescence cored cord of an electroluminescence cord in the art as an electroluminescence cored bar or an electroluminescence cored cord which base on a metal foil strip 8 or a metal wire 9 coated with an insulating medium layer 10 and then a layer 11 of mixture of fluorescent powder and binder and then a transparent conductive layer 12 in sequence (see FIGS. 2 and 3). To save cost, usually only one side exposed in the electroluminescence cored bar is coated with the layer of fluorescent powder. In the present invention, there is a central axis formed by an insulated power cord (including a live wire 4, a zero phase wire 6 and insulation layer 13) which is intertwisted helically by a bare metal wire 5. the electroluminescence cored bar or cord 1, 2, 3 intertwiste helically on said central axis so that the respective transparent conductive layer 12 of the electroluminescence cored bar or cord 1, 2, 3 is in contact with the bare metal wire 5, and then the whole cable will be encapsulated by the transparent plastics layer 7 finally to form a current-seen cable.

There are no shadow or a helical black line on the exposed side of every electroluminescence cored cord because a bare metal wire is arranged on the central axis where electroluminescence cored bar or cord is intertwisted helically. And the cross-section or diameter of the bare metal wire can be equal to or greater than that of the metal base strip so that the difference of resistance between said wire and said strip become less, the effective length of the cable which can emit light section by section in sequence is greater than that of the conventional electroluminescence cord.

In operation, a metal base strip 8 or a metal conductive wire base 9 of the electroluminescence cored bar or cord 1, 2, 3 is connected to a AC output line of each of group 32, 31, 30 output of a plurality of AC drivers 28 via a wire respectively, in other words, a AC output line of group 32 is connected to a metal base strip or cord of the electroluminescence cored bar or cord 1, a AC output line of group 31 is connected to a metal base strip or cord of the electroluminescence cored bar or cord 2, and a AC output line of group 30 is connected to a metal base strip or cord of the electroluminescence cored bar or cord 3, whereas a bare metal wire 5 as a central axis is connected to an other AC output line of each of group 32, 31, 30 output of a plurality of AC drivers 28 and the input power ends of the driver 28 are connected to a live wire 4 and a zero phase line or a ground line 6 of the power in parallel respectively, and a switch 38.

When the switch 38 is turn on, the driver 28 works and outputs the current to a first group 32, a second group 31 and a third group 30 via the AC-DC rectifier (or DC) 34, the high-frequency inverter circuit 33 and the three-group output circuit 29, but these three group AC outputs can not be energized simultaneously under the control of the program-operated chip 37. The program-operated chip 37 is driven by the high-frequency inverter circuit 33 and the synchronization circuit 35 via the DC voltage stabilization circuit 36, and controls three group AC output line 32, 31, 30 to turn on or turn off in sequence, hence controls the relevant electroluminescence cored bar or cord 1, 2, 3 to emits and dies light periodically in sequence; in other words, first the AC output line 32 is live and the electroluminescence cored bar or cord 1 emits and dies light, then the AC output line 31 is live and the electroluminescence cored bar or cord 2 emits and dies light, again then the AC output line 30 is live and the electroluminescence cored bar or cord 3 emits and dies light, the electroluminescence cored bar or cord 1, 2, 3 to emits and dies light circularly continuously periodically, the circulatory period is from 0.2 to 0.9 second, so whole current-seen cable is shown as a kind of lighting phenomenon in which a lighting section of said cable goes after another section next to it, the visual direction for going after light is from power to the electric appliance. In order to enhance the lighting effect of said current-seen cable, the insulation layer 13 of the power cord can be made of electroluminescence plastic or light sensitization glisten plastic, as well as a strip of electroluminescence plastic or a strip 14 with light sensitization glisten plastic coating is provided on a transparent plastics layer 7 of the power cord.

Embodiment 2

Figure 6:
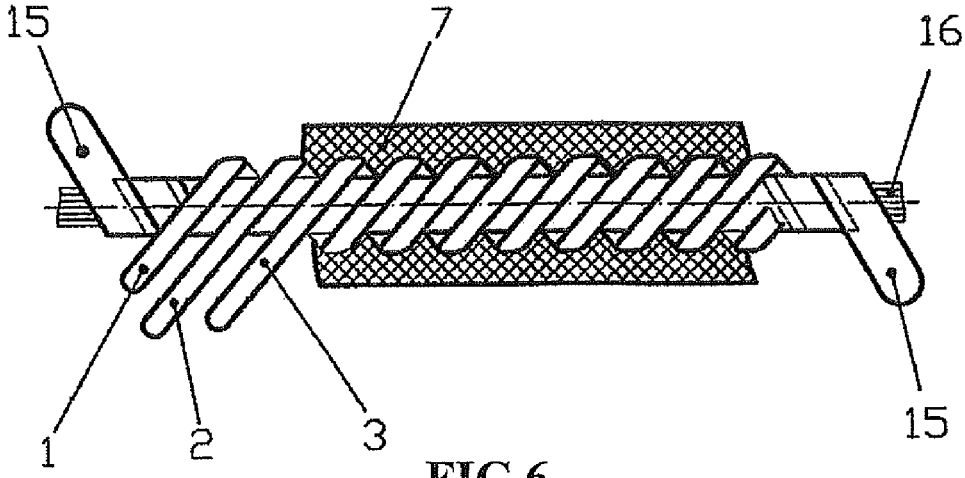
FIG. 6 is a schematic diagram of a second configuration of the present invention.
Figure 7:
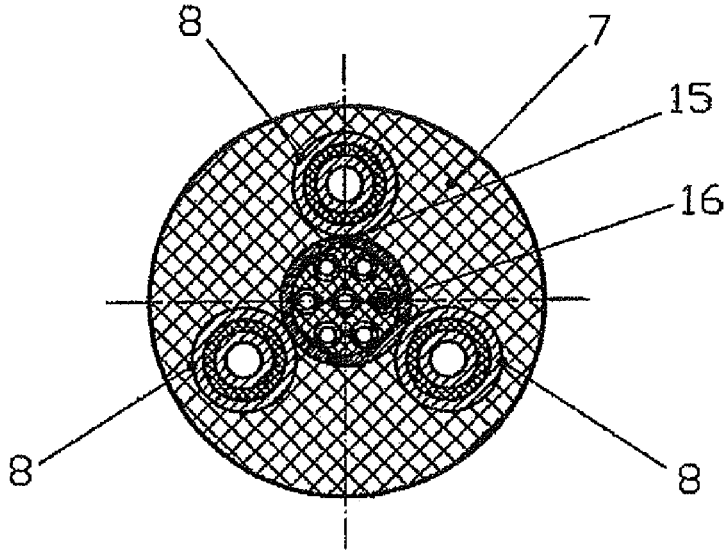
FIG. 7 is a radial sectional view of a second configuration of the present invention.

Referring to FIGS. 6 and 7, there is a central axis formed by a multi-cored signal cord 16 which is intertwisted helically by a metal foil strip 15, the electroluminescence cored bar or cord 1, 2, 3 intertwiste helically on said central axis, the whole cable will be encapsulated by the transparent plastics layer 7 to form a lighting signal cable in which a lighting section goes after another section next to it, as a current-seen cable. In this embodiment, its driving way by driver for lighting is the same as in embodiment 1, the signal cord is supplied with power in synchronizing with the driver 28, but when the signal current is DC, a DC power source is in parallel connected with the driver 28 and the DC is directly supplied to the high-frequency inverter circuit 33.

Embodiment 3

Figure 8:
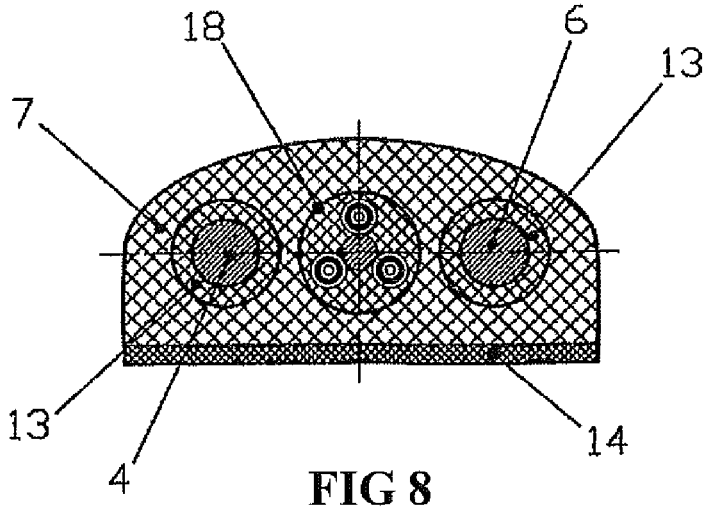
FIG. 8 is a radial sectional view of a third configuration of the present invention.

Referring to FIG. 8, there is a central axis formed by an metal bare wire 5 in which the electroluminescence cored bar or cord 1, 2, 3 are intertwisted helically in sequence, and then a electroluminescence cable 18 which can emit light section by section in sequence is formed. (see FIGS. 9 and 10). The power cord 4 and 6 having outer insulation layer 13 are arranged beside said electroluminescence cable 18, said electroluminescence cable 18 and power cord 4 and 6 will be encapsulated by the transparent plastics layer 7 finally to form a current-seen cable.

In order to enhance the lighting effect of said current-seen cable, a strip of electroluminescence plastic or a plastic insulating strip 14 with light sensitization glisten coating is bound on a transparent plastics layer 7 of the present invention.

Embodiment 4

Figure 9:
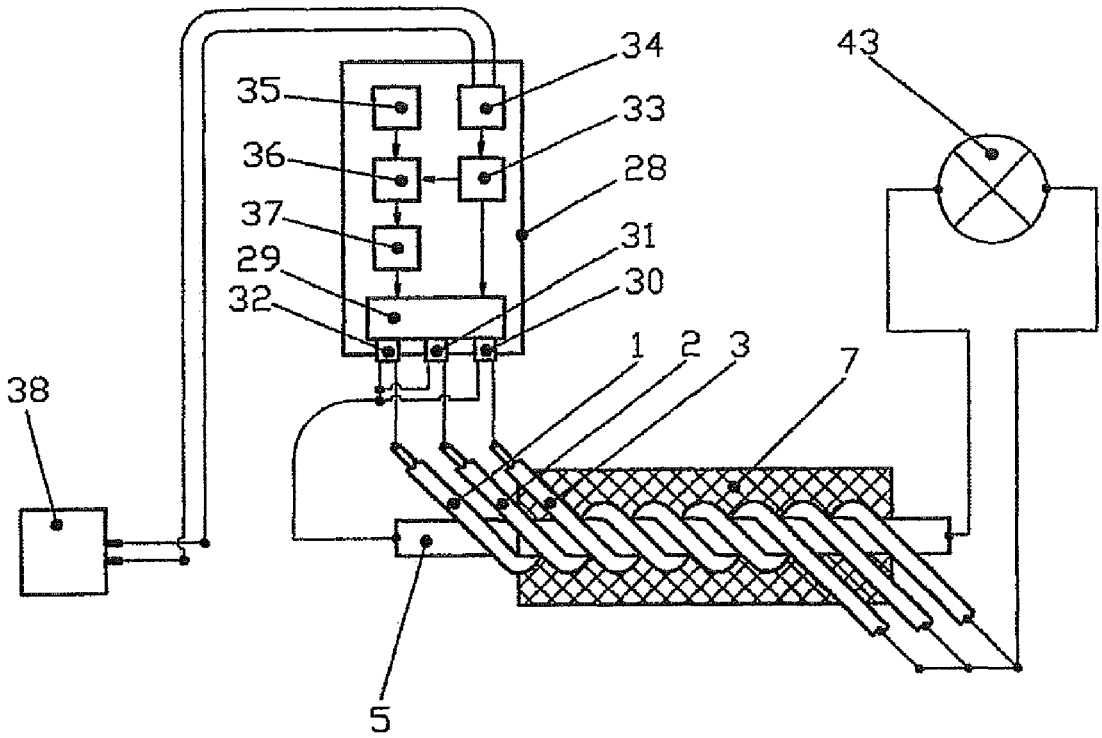
FIG. 9 is a schematic diagram of a fourth configuration of the present invention.
Figure 10:
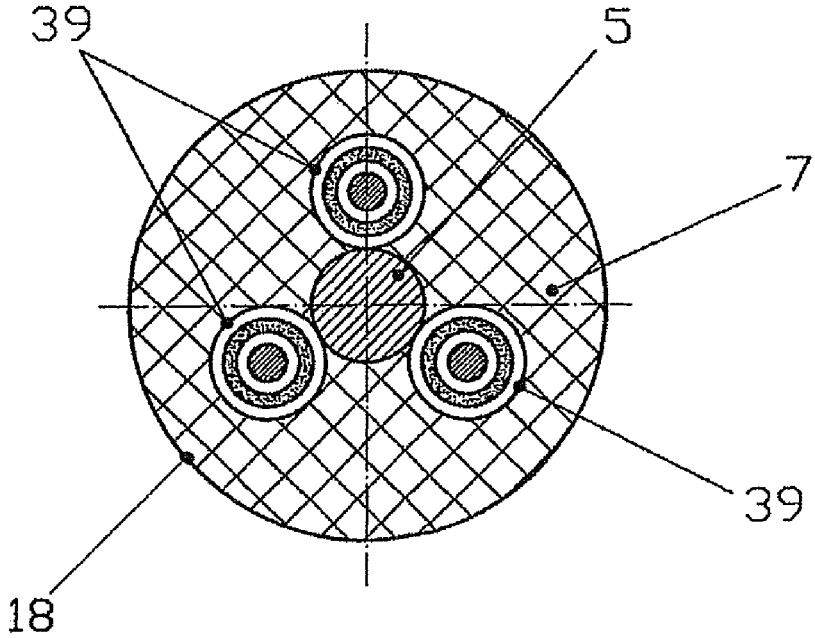
FIG. 10 is a radial sectional view of a fourth configuration of the present invention.

Referring to FIGS. 9 and 10, there is a central axis formed by an metal bare wire 5 in which the electroluminescence cored bar or cord 1, 2, 3 are intertwisted helically in sequence, which is encapsulated by the transparent plastics layer 7, in this embodiment, the main cord is omitted and the bare metal wire 5 and the metal base strip 8 or 9 of the electroluminescence cored bar or cord 1, 2, 3 are used as the main cord, which combine the electroluminescence cable and the power cable to a cable which is the simplest structure of the present invention.

In operation, one end of the metal bare wire 5 and the metal foil base strip 8 or the metal conductive wire base 9 of the electroluminescence cored bar or cord 1, 2, 3 in said the electroluminescence cable (As the main cord, the diameter of the metal bare wire 5 is the same as that of the metal foil base strip 8 or the metal conductive wire base 9 of the electroluminescence cored bar or cord 1, 2, 3 because said wire 5 and said strip 8 or wire base 9 are as a main cord) is connected to the multi-group AC output line of the driver 28 and the other end is connected to an electric appliance 43.

Embodiment 5

Figure 11:
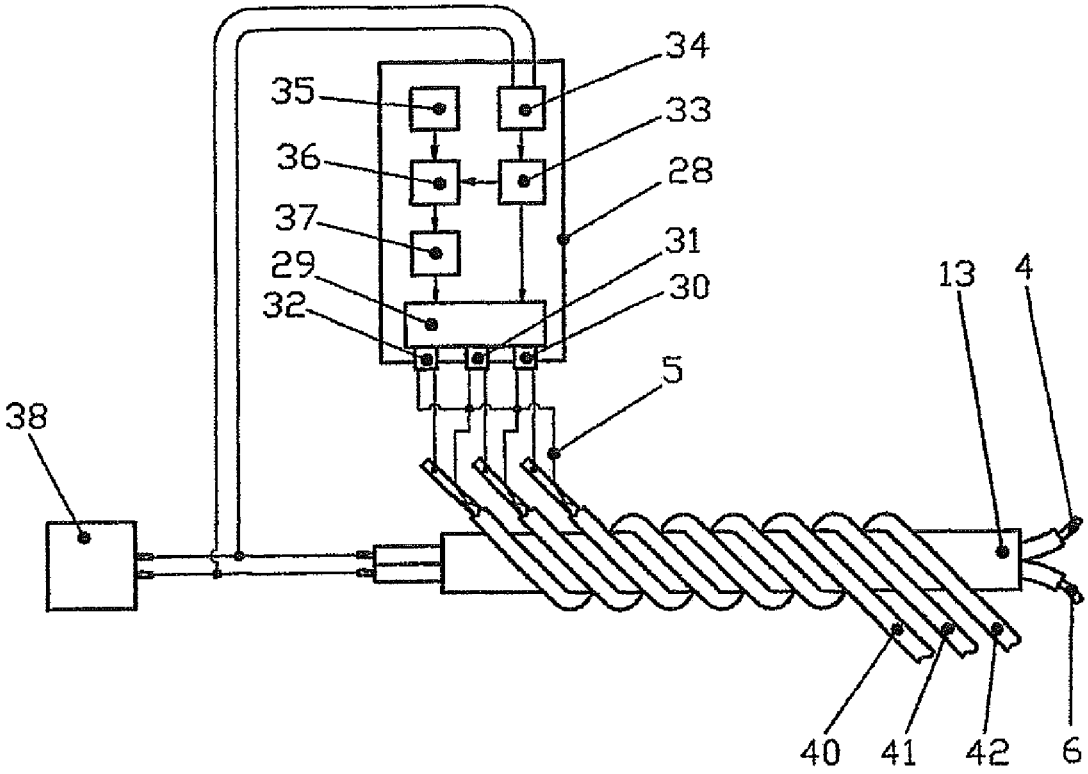
FIG. 11 is a schematic diagram of a fifth configuration of the present invention.
Figure 12:
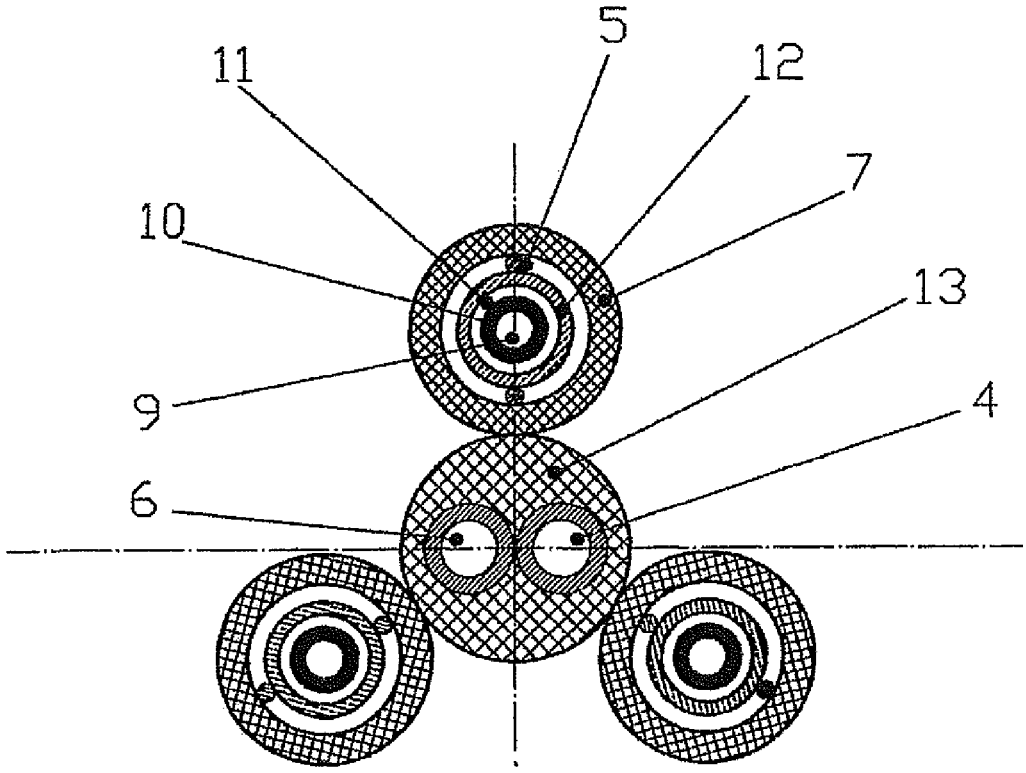
FIG. 12 is a radial sectional view of a fifth configuration of the present invention.

As shown in FIGS. 11 and 12, three electroluminescence cords 40, 41, 42 are intertwisted helically to form an electroluminescence cable, each metal bare wire on the conductive layer of said electroluminescence cords 40, 41, 42 is combined with each other and then is connected to a AC output line of each of multi-group output drivers, a metal base strip of each said electroluminescence cord is connected to an other AC output line of each of multi-group output drivers respectively. A main cord can be arranged in the central axis of said electroluminescence cable or lateral to said electroluminescence cable. Its driving way by driver for lighting is the same as in embodiment 1.

Embodiment 6

Figure 14:
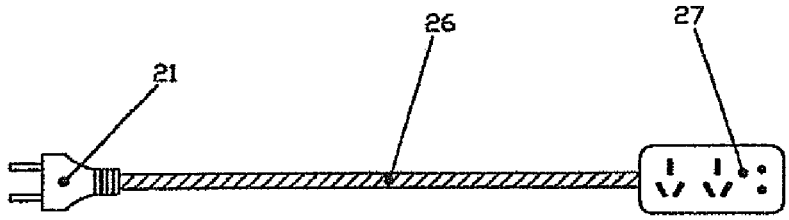
FIG. 14 is a schematic diagram of a second application of the present invention.

As shown in FIG. 14, one end of a current-seen power cable 26 of the present invention is connected to a plug 21 encapsulating a multi-group output driver, the other end is connected to an AC electrical outlet board 27. When an electric appliance is connected to said board 27 via a plug and turn on, a current-seen power cable 26 is shown as a kind of lighting phenomenon in which a lighting section of said cable goes after another section next to it in sequence.

Embodiment 7

Figure 13:
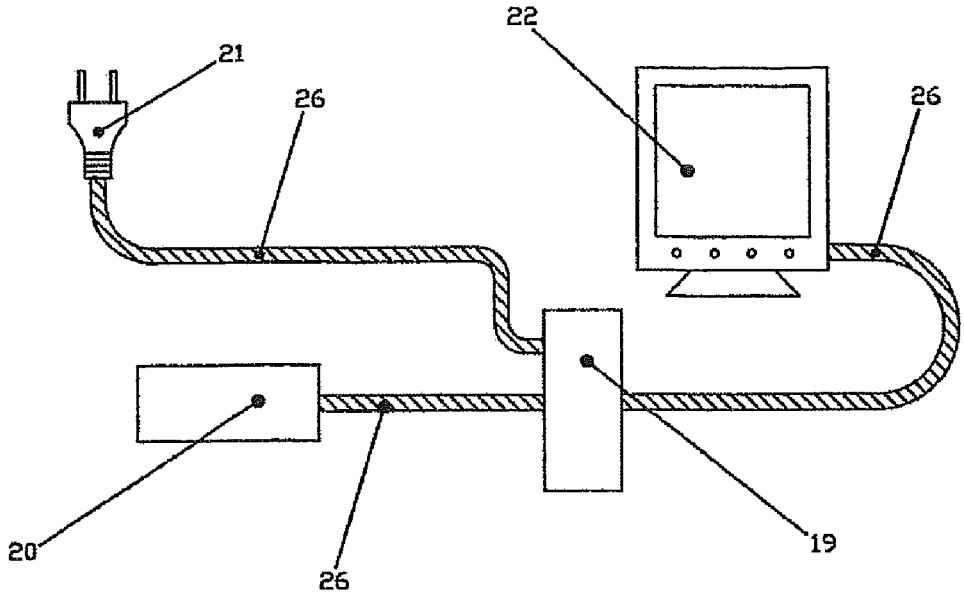
FIG. 13 is a schematic diagram of a first application of the present invention.

As shown in FIG. 13, one end of a current-seen power cable 26 of the present invention is connected to a power plug 21 encapsulating a driver, the other end is connected to a computer 19. When the computer turn on, the current-seen power cable will emit light section by section in sequence and indicate visually that the power current is inputting into the computer. For an other current-seen cable 26, one end of said current-seen cable 26 is connected to the computer 19 and the other end is connected to a monitor 22 and a printer 20. When the monitor or the printer is working, the current-seen cable 26 is shown as a kind of lighting phenomenon in which a lighting section of said cable goes after another section next to it in sequence and indicates visually the status of the signal currents.

Embodiment 8

Figure 15:
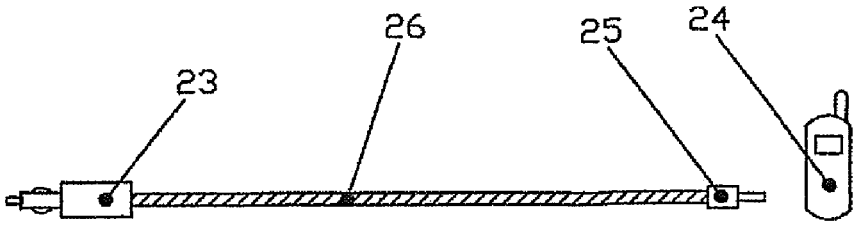
FIG. 15 is a schematic diagram of a third application of the present invention.
Figure 16:
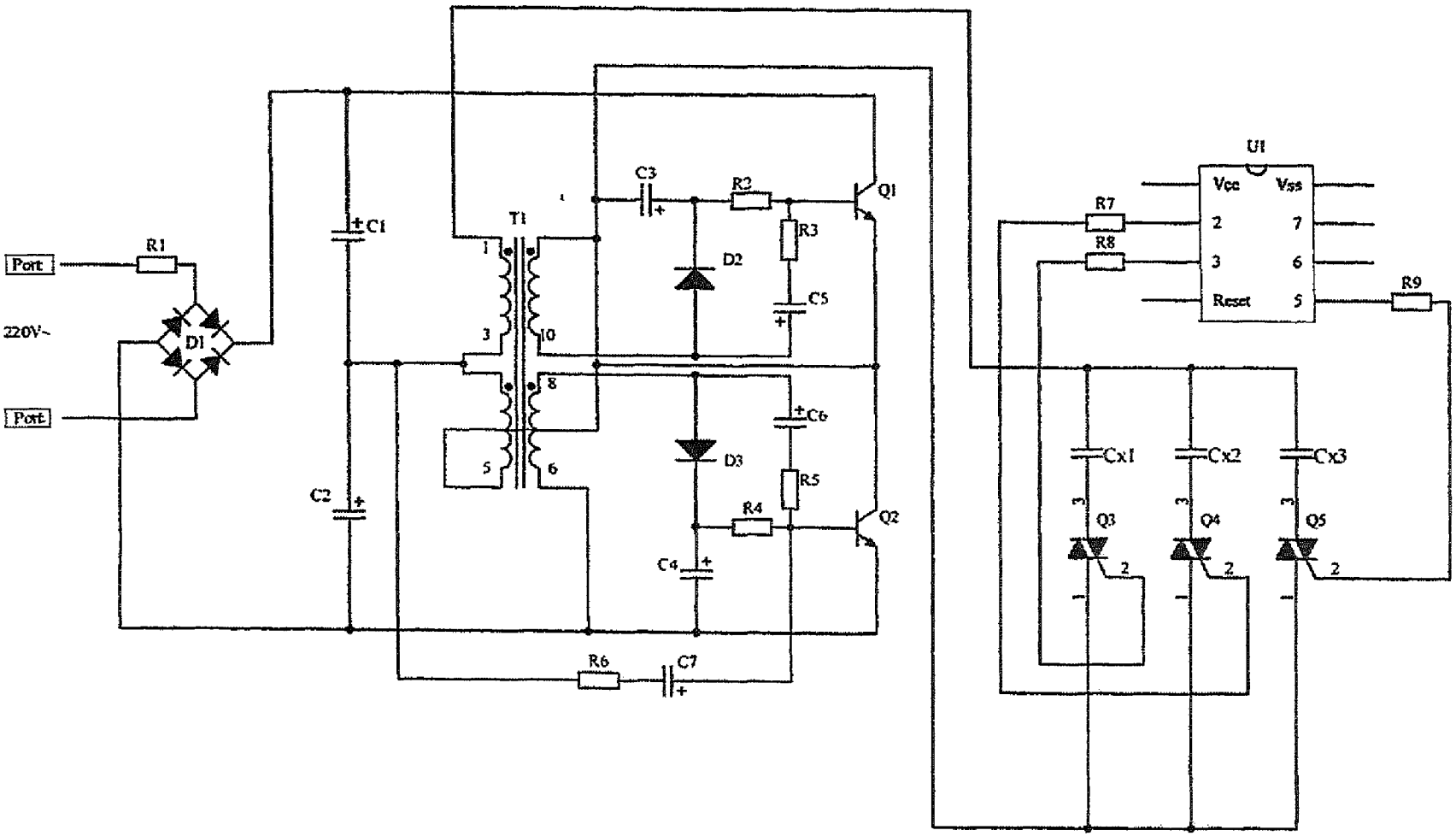
FIG. 16 is the driver's circuit diagram of the present invention.

As shown in FIG. 15, one end of a current-seen power cable 26 of the present invention is connected to a plug 23 encapsulating a driving and a charging circuit used in the vehicle, the other end is connected to a plug 25 which will be connect to mobile phone 24 or any other electric appliance. When the plug 23 plug in an electrical outlet in the vehicle, the current-seen cable 26 will emit light section by section and indicate visually the direction of the current which goes toward the mobile phone or other electric appliance.

The present invention can be used in a variety of electrical device and household appliance, and show the working status as a power input cable; the current-seen cable of the present invention can be a power cord or a signal cord used in computers, telecommunication and communication technical fields for indicating visually their working state of power or signal. Additionally, the present invention can widely used in a variety of illumination and decoration fields and also used in a fire protection warning sign system.

It is understood by those skilled in the art that the above embodiments are used only for elucidating the principle of the invention but not for the protection scope of limitation. Any obvious alterations or improvement according to the present invention may be incorporated into ambit of the present invention. For example, a plurality of electroluminescence cords are arrayed abreast and are intertwisted helically in sequence to be a electroluminescence cable which is insulated from the main cord and emit light section by section, or a multi-cored electroluminescence cord are arrayed abreast and are intertwisted helically in sequence to be a electroluminescence cable which is insulated from the main cord and emit light section by section, their technical effect between above solutions is the same and is also incorporated into ambit of the present invention.

What is claimed is:

1. A current-seen cable, includes a driver, a main cord, a bare metal wire, a plurality of electroluminescence cored bars or electroluminescence cored cords and an outer transparent plastic layer, wherein said a plurality of electroluminescence cored bars or electroluminescence cored cords are arrayed abreast and are intertwisted helically in sequence to form an electroluminescence cable, the bare metal wire is arranged in the center of the current-seen cable or lateral to the current-seen cable and is in contact with a conductive layer of each electroluminescence cored bar or electroluminescence cored cord; a metal base strip of each electroluminescence cored bar or a conductive wire of each electroluminescence cored cord and the bare metal wire are connected to each corresponding end of a multi-group AC output of the driver respectively; the main cord is arranged in the centre axis of the current-seen cable or lateral to the current-seen cable; said current-seen cable, said bare metal wire and said main cord are encapsulated in the outer transparent plastics layer; every electroluminescence cored bar or electroluminescence cored cord is driven by the driver and emits light in sequence when the main cord and the driver are live.

2. The current-seen cable according to claim 1, wherein an insulation layer of the main cord is made of rubber.

3. The current-seen cable according to claim 1, wherein an insulation layer of the main cord is made of plastic.

4. The current-seen cable according to claim 1, wherein an insulation layer of the main cord is made of electroluminescence plastic.

5. The current-seen cable according to claim 1, wherein an insulation layer is made of light sensitization glisten plastic.

6. A current-seen cable, includes a main cord, a driver, a metal hosetube, a plurality of electroluminescence cored bars or electroluminescence cored cords and an outer transparent plastic layer, wherein the main cord is inside the metal hosetube; said plurality of electroluminescence cored bars or electroluminescence cored cords are arrayed abreast and are intertwisted helically in sequence on said metal hosetube, and encapsulated in the outer transparent plastic layer; a metal base strip of each electroluminescence cored bar or a conductive wire of each electroluminescence cored cord and the metal hosetube are connected to each corresponding end of a multi-group AC output of the driver respectively; every electroluminescence cored bar or electroluminescence cored cord is driven by the driver and emits light in sequence when the main cord and the driver are live.

7. A current-seen cable, includes a driver, a main cord surrounded by an insulation layer, a plurality of electroluminescence cored cords which comprise a conductive wire surrounded by an insulating coat, an electroluminescence powder coat coated on said insulating coat and a transparent conductive layer coated on said electroluminescence powder coat, and an outer transparent plastic layer, wherein said plurality of electroluminescence cored cords are arrayed abreast and are intertwisted helically in sequence to form an electroluminescence cable; the main cord is arranged in the center of the electroluminescence cable or lateral to the electroluminescence cable; said electroluminescence cable and said main cord are encapsulated in the outer transparent plastic layer; every electroluminescence cored cord is driven by the driver and emits in sequence when the main cord and the driver are live.

8. A current-seen cable according to claim 7, wherein the insulation layer of the main cord is made of rubber.

9. A current-seen cable according to claim 7, wherein the insulation layer of the main cord is made of plastic.

10. A current-seen cable according to claim 7, wherein the insulation layer of the main cord is made of electroluminescence plastic.

11. A current-seen cable according to claim 7, wherein the insulation layer of the main cord is made of light sensitization glisten plastic.

12. A current-seen cable, includes a driver with a multi-group AC output, at least a bare metal wire, a plurality of electroluminescence cored bars or electroluminescence cored cords which comprise a metal base strip or a conductive wire surrounded by an insulating coat, an electroluminescence powder coat coated on said insulating coat and a transparent conductive layer coated on said electroluminescence powder coat, and an outer transparent insulation layer, wherein said bare metal wire is at the center axis of the current-seen cable, said plurality of electroluminescence cored bars or electroluminescence cored cords whose electroluminescence powder coat is semi ring shaped on the outboard of the current-seen cable are arrayed abreast and are intertwisted helically in sequence on said bare metal wire, and are encapsulated by said outer transparent insulation layer; the metal base strip of each electroluminescence cored bar or the conductive wire of each electroluminescence cored cord and the bare metal wire are connected to each corresponding end of the multi-group AC output of the driver respectively; every electroluminescence cored bar or electroluminescence cored cord is driven by the driver and emits light in sequence when the driver is live.

* * * * *